US008966885B2

(12) United States Patent
Flynn

(10) Patent No.: US 8,966,885 B2
(45) Date of Patent: Mar. 3, 2015

(54) DEVICE, METHOD, AND SYSTEM FOR EMISSIONS CONTROL

(75) Inventor: Paul Lloyd Flynn, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 847 days.

(21) Appl. No.: 13/098,509

(22) Filed: May 2, 2011

(65) Prior Publication Data

US 2012/0279201 A1 Nov. 8, 2012

(51) Int. Cl.
*F01N 3/035* (2006.01)
*F01N 3/023* (2006.01)
*F01N 3/10* (2006.01)

(52) U.S. Cl.
CPC ..... *F01N 3/0231* (2013.01); *F01N 3/035* (2013.01); *F01N 3/106* (2013.01); *F01N 2510/068* (2013.01)
USPC ..... 60/297

(58) Field of Classification Search
USPC ..... 60/297, 311
See application file for complete search history.

(56) References Cited

U.S. PATENT DOCUMENTS 6,813,884 B2 11/2004 Shigapov
7,431,749 B2 10/2008 Kim
7,797,931 B2 9/2010 Dubkov
2008/0060348 A1 * 3/2008 Robel et al. ..... 60/295
2009/0235649 A1 9/2009 Zhang
2009/0277429 A1 * 11/2009 Marsh et al. ..... 123/568.12
2011/0014099 A1 * 1/2011 Dornhaus et al. ..... 423/213.5
2011/0132194 A1 * 6/2011 Ahmed et al. ..... 95/273

FOREIGN PATENT DOCUMENTS

JP 06071181 A * 3/1994 ..... B01J 29/30

OTHER PUBLICATIONS

"Euro 4 Engine and Aftertreatment Technology", European Engine Oils, The Lubrizol, pp. 1-3.
"Diesel Soot Oxidation with NO2: Engine Experiments and Simulations", Industrial & Engineering Chemistry Research, 2002; Ioannis P. Kandylas; Onoufrios A. Haralampous and Grigorios C. Koltsakis.
"Exhaust Aftertreatment Advanced Emission Controls", Cummins.

* cited by examiner

*Primary Examiner* — Kenneth Bomberg
*Assistant Examiner* — Jonathan Matthias
(74) *Attorney, Agent, or Firm* — GE Global Patent Operation; John A. Kramer

(57) ABSTRACT

Various embodiments for an exhaust gas treatment device are provided. In one example, the exhaust gas treatment device includes a first substrate coated with a low temperature catalyst configured to operate under a first, low temperature range. The exhaust gas treatment device further includes a second substrate coated with a high temperature catalyst positioned downstream of the first substrate, the high temperature catalyst configured to operate under a second, high temperature range. Further, in the first and second temperature ranges, particulate matter is oxidized at the second substrate.

20 Claims, 6 Drawing Sheets

DEVICE, METHOD, AND SYSTEM FOR EMISSIONS CONTROL

FIELD

Embodiments of the subject matter disclosed herein relate to exhaust gas treatment devices and systems for an engine.

BACKGROUND

An exhaust gas treatment device may be included in an exhaust system of an engine in order to reduce regulated emissions. In one example, the exhaust gas treatment device may include a diesel particulate filter (DPF) or other particulate matter filter. When a DPF is included, regeneration may be employed to clean the filter by increasing the temperature for burning particulate matter that has collected in the filter. Passive regeneration may occur when a temperature of the exhaust gas is high enough to burn the particulate matter in the filter. In some examples, such as when the DPF is positioned downstream of a turbocharger, the exhaust gas may not have a high enough temperature and active regeneration may be carried out. During active regeneration, fuel may be injected and burned in the exhaust passage upstream of the DPF in order to drive the temperature of the DPF up to a temperature where the particulate matter will burn. As such, fuel consumption is increased, thereby decreasing fuel economy.

BRIEF DESCRIPTION

In one embodiment, an exhaust gas treatment device includes a first substrate coated with a low temperature catalyst configured to operate under a first, low temperature range. The exhaust gas treatment device further includes a second substrate coated with a high temperature catalyst positioned downstream of the first substrate, the high temperature catalyst configured to operate under a second, high temperature range. Further, in the first and second temperature ranges, particulate matter is oxidized at the second substrate.

By including a high temperature catalyst and a low temperature catalyst, passive regeneration may occur over a wider range of temperatures. In some embodiments, the low temperature catalyst may facilitate formation of an oxidizer which consumes particulate matter in the second substrate. Further, the high temperature catalyst may facilitate consumption of particulate matter in the second substrate by an exhaust gas constituent. As such, a build-up of particulate matter in the substrates may be reduced, thereby reducing a frequency of active regeneration. In this manner, fuel consumption may be reduced.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of an exhaust gas treatment device which includes a first substrate coated with a low temperature catalyst configured to operate under a first, low temperature range. As used herein, "low temperature catalyst" implies a catalyst that is active in a relatively low temperature range (e.g., between 150° C. and 300° C.). The exhaust gas treatment device further includes a second substrate coated with a high temperature catalyst positioned downstream of the first substrate, the high temperature catalyst configured to operate under a second, high temperature range. As used herein, "high temperature catalyst" implies a catalyst that is active at relatively high temperatures (e.g., between 300° C. and 600° C.). It should be understood the temperature ranges "between 150° C. and 300° C." and "between 300° C. and 600° C." are provided as examples and are not meant to be limiting. As such, temperatures outside these ranges may also be used.

Figure 1:
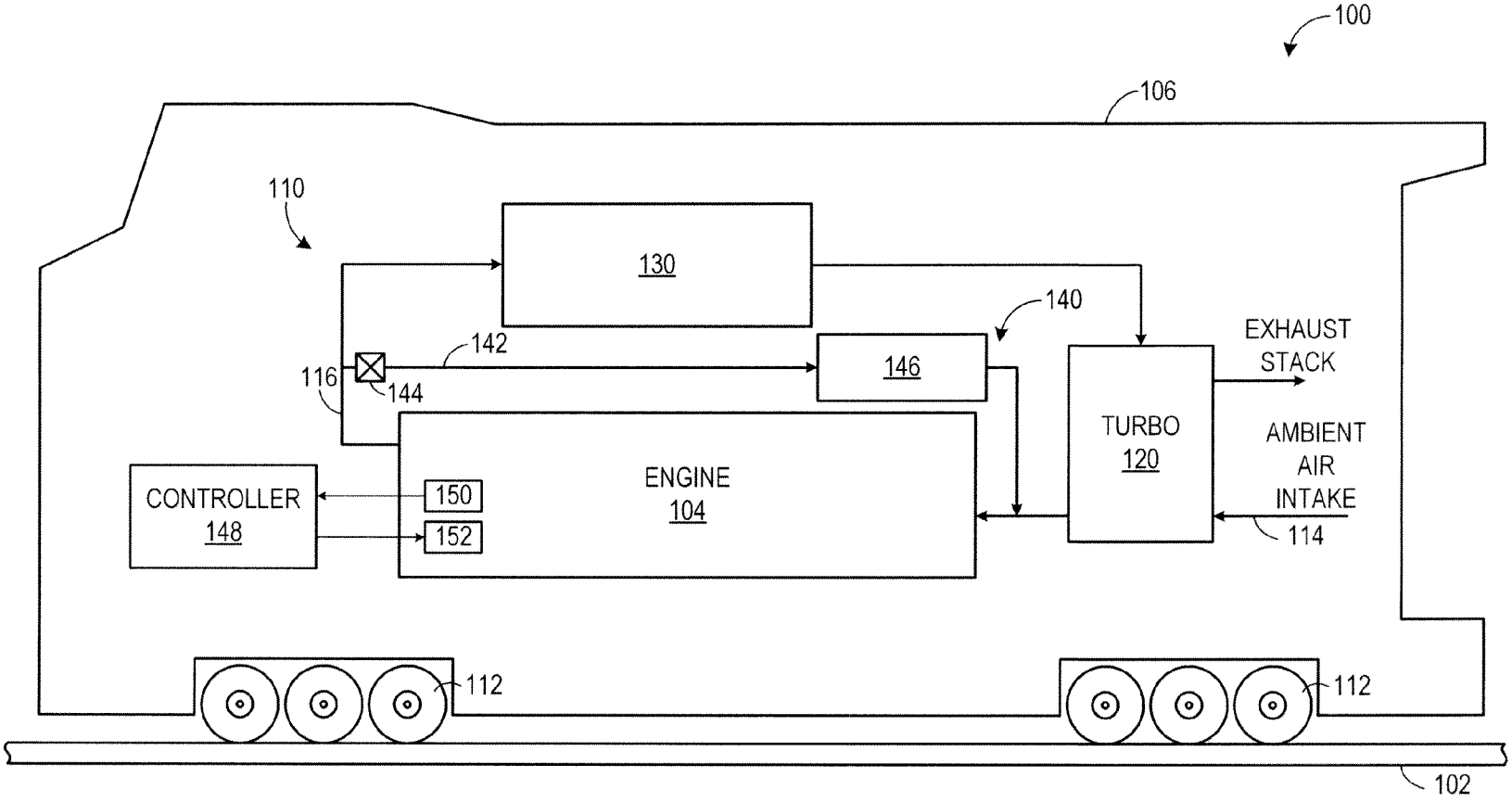
FIG. 1 shows a schematic diagram of an example embodiment of a rail vehicle with an exhaust gas treatment device according to an embodiment of the invention.

In some embodiments, the low temperature catalyst may facilitate formation of an oxidizer, such as $NO_2$, which consumes particulate matter in the second substrate when exhaust gas temperature is in the first, low temperature range. Further, the high temperature catalyst may facilitate consumption of particulate matter in the second substrate by an exhaust gas constituent, such as $O_2$, when the exhaust gas temperature is in the second, high temperature range. In some examples, the exhaust gas treatment device may be positioned upstream of a turbocharger in an exhaust passage of an engine where exhaust gas has a higher temperature. As such, a build-up of particulate matter in the substrates may be reduced, thereby reducing a frequency of active regeneration In some embodiments, the exhaust gas treatment device may be configured for an engine in a vehicle, such as a rail vehicle. For example, FIG. 1 shows a block diagram of an example embodiment of a vehicle system 100 (e.g., a locomotive system), herein depicted as a rail vehicle 106, configured to run on a rail 102 via a plurality of wheels 112. As depicted, the rail vehicle 106 includes an engine system 110 with an engine 104. In other non-limiting embodiments, engine 104 may be a stationary engine, such as in a powerplant application, or an engine in a marine vessel or off-highway vehicle propulsion system.

The engine 104 receives intake air for combustion from an intake passage 114. The intake passage 114 receives ambient air from an air filter (not shown) that filters air from outside of the rail vehicle 106. Exhaust gas resulting from combustion in the engine 104 is supplied to an exhaust passage 116. Exhaust gas flows through the exhaust passage 116, and out of an exhaust stack of the rail vehicle 106. In one example, the engine 104 is a diesel engine that combusts air and diesel fuel through compression ignition. In other non-limiting embodiments, the engine 104 may combust fuel including gasoline, kerosene, biodiesel, or other petroleum distillates of similar density through compression ignition (and/or spark ignition).

The engine system 110 includes a turbocharger 120 that is arranged between the intake passage 114 and the exhaust passage 116. The turbocharger 120 increases air charge of ambient air drawn into the intake passage 114 in order to provide greater charge density during combustion to increase power output and/or engine-operating efficiency. The turbocharger 120 may include a compressor (not shown) which is at least partially driven by a turbine (not shown). While in this case a single turbocharger is included, the system may include multiple turbine and/or compressor stages.

The engine system 110 further includes an exhaust gas treatment device 130 coupled in the exhaust passage upstream of the turbocharger 120. As will be described in greater detail below, the exhaust gas treatment device 130 may include one or more components. In one example embodiment, the exhaust gas treatment device 130 may include a diesel oxidation catalyst (DOC) and a diesel particulate filter (DPF), where the DOC is positioned upstream of the DPF in the exhaust gas treatment device. In other embodiments, the exhaust gas treatment device 130 may additionally or alternatively be a selective catalytic reduction (SCR) catalyst, three-way catalyst, $NO_x$ trap, various other emission control devices or combinations thereof.

Further, in some embodiments, a burner may be included in the exhaust passage such that the exhaust stream flowing through the exhaust passage upstream of the exhaust gas treatment device may be heated. In this manner, a temperature of the exhaust stream may be increased to facilitate active regeneration of the exhaust gas treatment device. In other embodiments, a burner may not be included in the exhaust gas stream.

The engine system 110 further includes an exhaust gas recirculation (EGR) system 140, which routes exhaust gas from the exhaust passage 116 upstream of the exhaust gas treatment device 130 to the intake passage downstream of the turbocharger 120. The EGR system 140 includes an EGR passage 142 and an EGR valve 144 for controlling an amount of exhaust gas that is recirculated from the exhaust passage 116 of engine 104 to the intake passage 114 of engine 104. By introducing exhaust gas to the engine 104, the amount of available oxygen for combustion is decreased, thereby reducing the combustion flame temperatures and reducing the formation of nitrogen oxides (e.g., $NO_x$). The EGR valve 144 may be an on/off valve controlled by the controller 148, or it may control a variable amount of EGR, for example. In some embodiments, as shown in FIG. 1, the EGR system 140 further includes an EGR cooler 146 to reduce the temperature of the exhaust gas before it enters the intake passage 114. As shown in the non-limiting example embodiment of FIG. 1, the EGR system 140 is a high-pressure EGR system. In other embodiments, the engine system 110 may additionally or alternatively include a low-pressure EGR system, routing EGR from downstream of the turbine to upstream of the compressor.

The rail vehicle 106 further includes a controller 148 to control various components related to the vehicle system 100. In one example, the controller 148 includes a computer control system. The controller 148 further includes computer readable storage media (not shown) including code for enabling on-board monitoring and control of rail vehicle operation. The controller 148, while overseeing control and management of the vehicle system 100, may be configured to receive signals from a variety of engine sensors 150, as further elaborated herein, in order to determine operating parameters and operating conditions, and correspondingly adjust various engine actuators 152 to control operation of the rail vehicle 106. For example, the controller 148 may receive signals from various engine sensors 150 including, but not limited to, engine speed, engine load, boost pressure, exhaust pressure, ambient pressure, exhaust temperature, etc. Correspondingly, the controller 148 may control the vehicle system 100 by sending commands to various components such as traction motors, alternator, cylinder valves, throttle, etc. In one example, the controller 148 may adjust the position of the EGR valve 144 in order to adjust an air-fuel ratio of the exhaust gas or to modulate a temperature of the exhaust gas.

In one example embodiment, the vehicle system is a locomotive system which includes an engine cab defined by a roof assembly and side walls. The locomotive system further comprises an engine positioned in the engine cab such that a longitudinal axis of the engine is aligned in parallel with a length of the cab. Further, an exhaust gas treatment device is included, and is mounted on the engine within a space defined by a top surface of an exhaust manifold of the engine, the roof assembly, and the side walls of the engine cab such that a longitudinal axis of the exhaust gas treatment device is aligned in parallel with the longitudinal axis of the engine. The exhaust gas treatment device includes a first substrate coated with a low temperature catalyst positioned upstream of a second substrate coated with a high temperature catalyst. The exhaust gas treatment device is disposed upstream of a turbine of the turbocharger and configured to receive exhaust gas from the exhaust manifold of the engine.

Figure 2:
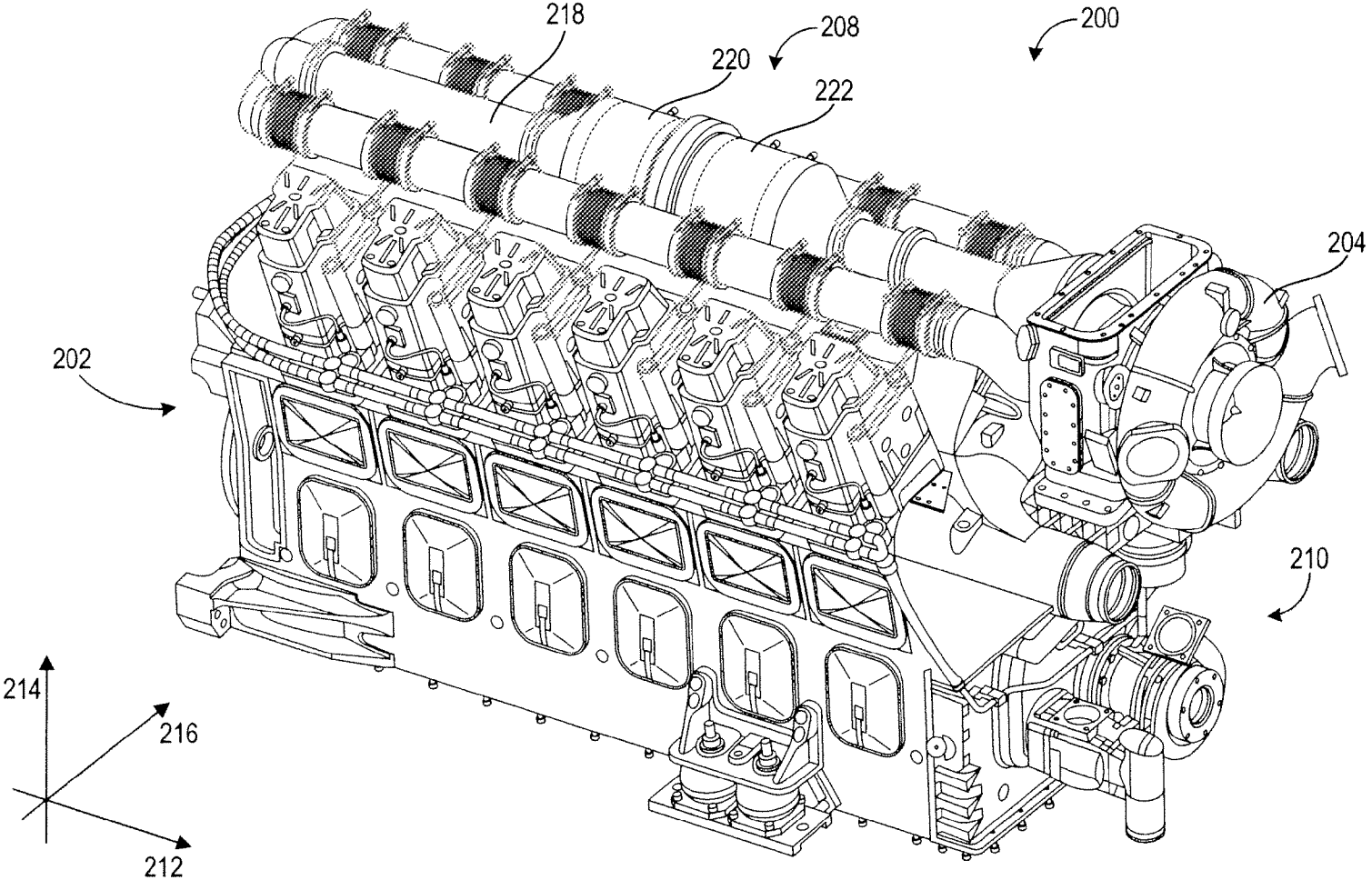
FIG. 2 shows a perspective view, approximately to scale, of an engine with a turbocharger and an exhaust gas treatment device.

Turning to FIG. 2, an example engine system 200 is illustrated, the engine system 200 including an engine 202, such as the engine 104 described above with reference to FIG. 1. FIG. 2 is approximately to-scale. The engine system 200 further includes a turbocharger 204 mounted on a front side of the engine and an exhaust gas treatment device 208 positioned on a top portion of the engine.

In the example of FIG. 2, engine 202 is a V-engine which includes two banks of cylinders that are positioned at an angle of less than 180 degrees with respect to one another such that they have a V-shaped inboard region and appear as a V when viewed along a longitudinal axis of the engine. The longitudinal axis of the engine is defined by its longest dimension in this example. In the example of FIG. 2, and in FIG. 3, the longitudinal direction is indicated by 212, the vertical direction is indicated by 214, and the lateral direction is indicated by 216. Each bank of cylinders includes a plurality of cylinders. Each of the plurality of cylinders includes an intake valve which is controlled by a camshaft to allow a flow of compressed intake air to enter the cylinder for combustion. Each of the cylinders further includes an exhaust valve which is controlled by the camshaft to allow a flow of combusted gases (e.g., exhaust gas) to exit the cylinder.

In the example embodiment of FIG. 2, the exhaust gas exits the cylinder and enters an exhaust manifold positioned within the V (e.g., in an inboard orientation). In other embodiments, the exhaust manifold may be in an outboard orientation, for example, in which the exhaust manifold is positioned outside of the V. In the example of FIG. 2, the engine 202 is a V-12 engine. In other examples, the engine may be a V-6, V-16, I-4, I-6, I-8, opposed 4, or another engine type.

As mentioned above, the engine system 200 includes a turbocharger 204 positioned at a front end 210 of the engine 202. In the example of FIG. 2, the front end 210 of the engine is facing toward a right side of the page. Intake air flows through the turbocharger 204 where it is compressed by a compressor of the turbocharger before entering the cylinders of the engine 202. In some examples, the engine further includes a charge air cooler which cools the compressed intake air before it enters the cylinder of the engine 202. The turbocharger is coupled to the exhaust manifold of the engine 202 such that exhaust gas exits the cylinders of the engine 202 and then flows through an exhaust passage 218 and enters an exhaust gas treatment device 208 before entering a turbine of the turbocharger 204. At locations upstream of the turbocharger, exhaust gas may have a higher temperature and a higher volume flow rate than at locations downstream of the turbocharger due to decompression of the exhaust gas upon passage through the turbocharger.

In other embodiments, the exhaust gas treatment device 208 may be positioned downstream of the turbocharger 204. As an example, if the exhaust gas treatment device is positioned in a rail vehicle that passes through tunnels (e.g., tunneling), a temperature of the exhaust gas may increase upon passage through a tunnel. In such an example, exhaust gas may have a higher temperature after passing through the turbocharger and passive regeneration of the exhaust gas treatment may occur, as will be described in greater detail below.

Figure 3:
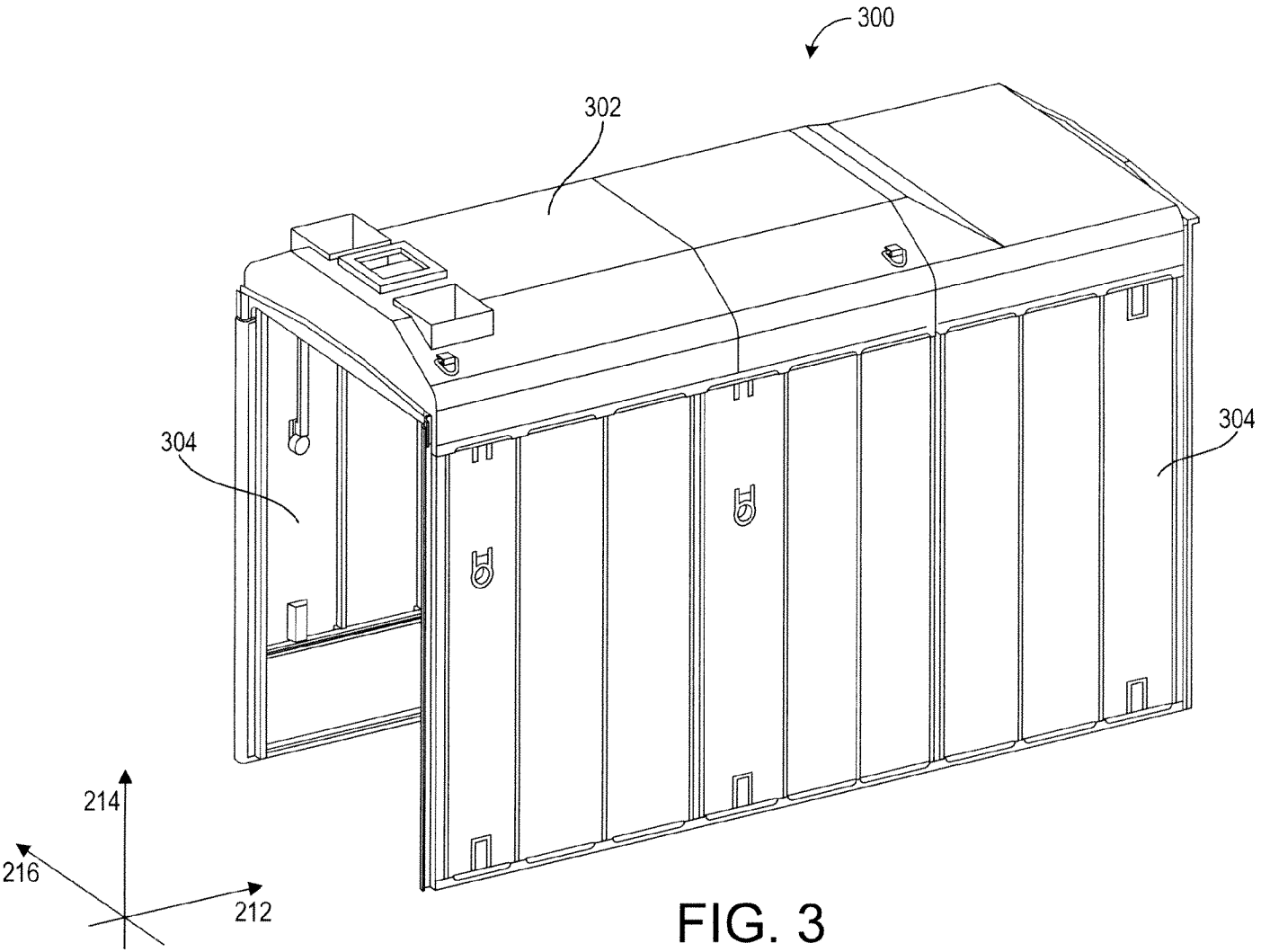
FIG. 3 shows a perspective view, approximately to scale, of an example embodiment of an engine cab.

In the example embodiment shown in FIG. 2, the exhaust gas treatment device 208 is positioned vertically above the engine 202. The exhaust gas treatment device 208 is positioned on top of the engine 202 such that it fits within a space defined by a top surface of an exhaust manifold of the engine 202, a roof assembly 302 of an engine cab 300, and the side walls 304 of the engine cab. The engine cab 300 is illustrated in FIG. 3. The engine 202 may be positioned in the engine cab 300 such that the longitudinal axis of the engine is aligned in parallel with a length of the cab 300. As depicted in FIG. 2, a longitudinal axis of the exhaust gas treatment device is aligned in parallel with the longitudinal axis of the engine.

The exhaust gas treatment device 208 is defined by the exhaust passage aligned in parallel with the longitudinal axis of the engine. In the example embodiment shown in FIG. 2, the exhaust gas treatment device 208 includes a first substrate coated with a low temperature catalyst 220 and a second substrate coated with a high temperature catalyst 222. As an example, the first substrate coated with the low temperature catalyst 220 may be a DOC and the second substrate coated with the high temperature catalyst 222 may be a cataylzed DPF, as will be described in greater detail below with reference to FIGS. 4 and 5.

In other non-limiting embodiments, the engine system 200 may include more than one exhaust gas treatment device, such as DOC, a DPF coupled downstream of the DOC, and a selective catalytic reduction (SCR) catalyst coupled downstream of the diesel particulate filter. In another example embodiment, the exhaust gas treatment device may include an SCR system for reducing $NO_x$ species generated in the engine exhaust stream and a particulate matter (PM) reduction system for reducing an amount of particulate matter, or soot, generated in the engine exhaust stream. The various exhaust after-treatment components included in the SCR system may include an SCR catalyst, an ammonia slip catalyst (ASC), and a structure (or region) for mixing and hydrolyzing an appropriate reductant used with the SCR catalyst, for example. The structure or region may receive the reductant from a reductant storage tank and injection system, for example.

In another embodiment, the exhaust gas treatment device 208 may include a plurality of distinct flow passages aligned in a common direction (e.g., along the longitudinal axis of the engine). In such an embodiment, each of the plurality of flow passages may include one or more exhaust gas treatment devices which may each include a low temperature catalyst and a low temperature catalyst.

By positioning the exhaust gas treatment device on top of the engine such that the exhaust passage is aligned in parallel with the longitudinal axis of the engine, as described above, a compact configuration can be enabled. In this manner, the engine and exhaust gas treatment device can be disposed in a space, such as an engine cab as described above, where the packaging space may be limited.

Further, by positioning the exhaust gas treatment device upstream of the turbocharger, further compaction of the configuration may be enabled. For example, upstream of the turbocharger, exhaust gas emitted from the engine is still compressed and, as such, has a greater volume flow rate than exhaust gas that has passed through the turbocharger. As a result, a size of the exhaust gas treatment device may be reduced.

Figure 4:
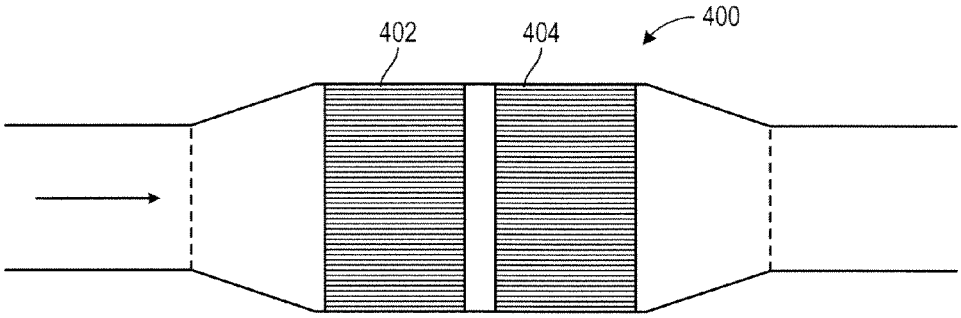
FIG. 4 shows a schematic diagram of an example embodiment of an exhaust gas treatment device according to an embodiment of the invention.

Continuing to FIG. 4, it shows an example embodiment of an exhaust gas treatment device 400 with a first substrate 402 coated with a low temperature catalyst and a second substrate 404 coated with a high temperature catalyst, where the second substrate 404 is disposed downstream of the first substrate 402, such as exhaust gas treatment device 208 described above with reference to FIG. 2.

The first substrate 402 may be a metallic (e.g., stainless steel, or the like) or a ceramic substrate, for example, with a monolithic honeycomb structure. The low temperature catalyst may be a coating of precious metal such as a platinum group metal (e.g., platinum, palladium, or the like) on the first substrate 402. Under a low temperature range, such as between 150° C. and 300° C., the low temperature catalyst may facilitate a chemical reaction. As such, the low temperature catalyst may operate during low load or idle conditions. In one embodiment, the low temperature catalyst may be a nitrogen oxide based catalyst that converts NO to $NO_2$. As an example, the first substrate coated with the low temperature catalyst may be a diesel oxidation catalyst.

The second substrate 404 may be a ceramic (e.g., cordierite) or silicon carbide substrate, for example, with a monolithic honeycomb structure. The high temperature catalyst may be a coating of an oxidized ceramic material and/or a mineral on the second substrate 404. For example, the high temperature catalyst may be a base metal and/or a rare earth oxide (e.g., iron, copper, yttrium, dysprosium, and the like). Under a high temperature range, such as between 300° C. and 600° C., the high temperature catalyst may facilitate a chemical reaction. As such, the high temperature catalyst may operate during high load conditions or, in the case of a rail vehicle, when the rail vehicle is passing through a tunnel. In one embodiment, the high temperature catalyst may be an oxygen based catalyst that facilitates particulate matter (e.g., soot) consumption with excess $O_2$ in the exhaust stream. As an example, the second substrate coated with the high temperature catalyst may be a catalyzed diesel particulate filter. In some embodiments, the diesel particulate filter may be a wall flow particulate filter. In other embodiment, the diesel particulate filter may be a flow through particulate filter.

Thus, one embodiment relates to an exhaust gas treatment device. The device comprises a first substrate coated with a low temperature catalyst, which is a platinum group metal (e.g., platinum, palladium, ruthenium, rhodium, osmium, or iridium). The device further comprises a second substrate coated with a high temperature catalyst, which is at least one of a base metal and a rare earth oxide (e.g., iron, nickel, lead, zinc, cerium, neodymium, lanthanum, and the like), positioned downstream of the first substrate. The first and second substrates may be co-located in a common housing, the housing defining a passageway, and the first substrate located on an upstream end of the passageway.

In an embodiment, an exhaust gas treatment device comprises a first substrate coated with a low temperature catalyst, which is a mixture of platinum and rhodium. The device further comprises a second substrate coated with a high temperature catalyst, which is cerium oxide, positioned downstream of the first substrate. The first and second substrates may be co-located in a common housing, the housing defining a passageway, and the first substrate located on an upstream end of the passageway.

In an embodiment, an exhaust gas treatment device comprises a housing defining an internal passageway and a particulate matter filter in the passageway. The exhaust gas treatment device further comprises a first catalyst and a second catalyst disposed in the internal passageway, wherein the first catalyst is configured to oxidize particulate matter in the particulate matter filter in a first, low temperature range, and wherein the second catalyst is configured to oxidize particulate matter in the particulate matter filter in a second, high temperature range, and wherein the first and second catalysts operate to maintain a balance point of particulate loading of the particulate matter filter within a loading range.

Balance point operation of the particulate matter filter may be operation in which particulate matter builds up on the filter at a particular rate and, due to catalyst operation, the particulate matter is consumed at a particular rate. For example, the balance point may be an equilibrium point in which build up and consumption of particulate matter occurs at substantially the same rate. The balance point may be based on engine operation, for example, such as exhaust temperature and engine load. Further, the balance point may be different for different particulate matter filters. As an example, a wall flow particulate matter filter may have a 90 percent capture rate of particulate matter, and a flow through particulate filter may have a 50 to 60 percent capture rate of particulate matter. Thus, the wall flow particulate matter filter may have a higher balance point than the flow through particulate matter filter.

As the balance point increases, particulate matter loading may increase, and as the balance point decreases, particulate matter consumption may increase. As the particulate matter loading reaches a critical point (e.g., the balance point increases to a critical point), active regeneration of the particulate matter filter may be initiated. As an example, the critical point may be a threshold amount of particulate matter in the filter, above which the effectiveness of the particulate matter filter decreases. Thus, the critical point may be a particulate matter filter loading at which active regeneration is initiated to remove particulate matter from the particulate matter filter. As such, the balance point may be maintained in a loading range below the critical point such that initiation of active regeneration is reduced. In one non-limiting embodiment, the loading range of the balance point may be within 20 to 30 percent of a critical point at which active regeneration of the particulate matter filter is initiated.

In another embodiment, an exhaust gas treatment device comprises a housing defining an internal passageway and a particulate matter filter in the passageway. The exhaust gas treatment device further comprises one or more catalysts disposed in the internal passageway, wherein the one or more catalysts are configured to oxidize particulate matter in the particulate matter filter in a first, low temperature range and in a second, high temperature range. Further, the low temperature operation will have a peak effectiveness at a certain temperature (e.g., between 150° C. and 300° C.). The effectiveness of the high temperature operation will increase with higher and higher temperature (e.g., between 300° C. and 600° C.).

Figure 5:
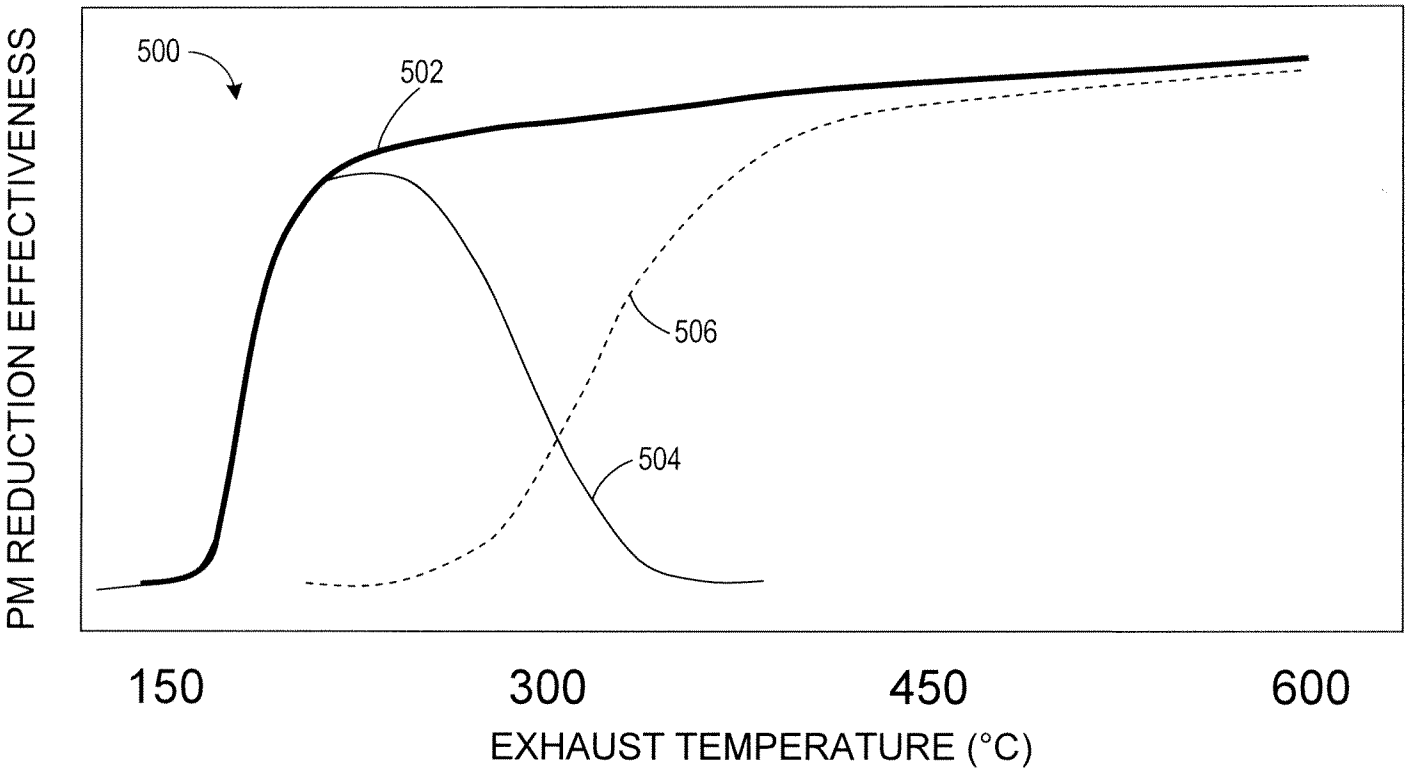
FIG. 5 shows a graph illustrating particulate matter reduction in an exhaust gas treatment device as a function of temperature.

FIG. 5 shows a graph 500 illustrating a particulate matter reduction in an exhaust gas treatment device, such as exhaust gas treatment device 400 described above with reference to FIG. 4, as a function of temperature. Curve 504 shows the temperature range in which the low temperature catalyst (e.g., the diesel oxidation catalyst) is most effective, which is in the temperature range between 150° C. and 300° C. Curve 506 shows the temperature range in which the high temperature catalyst (e.g., the catalyzed diesel particulate filter) is most effective, which is in the temperature range between 300° C. and 600° C.

As indicated by the curve 504 in FIG. 5, at lower exhaust temperatures, soot on the second substrate may be reduced by the low temperature catalyst. Further, at higher exhaust temperatures, the low temperature catalyst may not be effective due to its lower $NO_2$ conversion ratio. As such, the second substrate may be coated with a second, high temperature catalyst that facilitates the reduction of soot at higher exhaust temperatures.

As described above, the low temperature catalyst may be a nitrogen oxide based catalyst that converts NO to $NO_2$. As such, the $NO_2$ formed at the first substrate may flow to the second substrate where it will consume soot, thereby cleaning the second substrate by passive regeneration during periods when the exhaust temperature is relatively low. Further, the high temperature catalyst may be an oxygen based catalyst that facilitates particulate matter consumption with excess $O_2$ in the exhaust stream. As such, during periods when the exhaust temperature is relatively high, soot consumption may occur by passive regeneration.

In other words, the low temperature catalyst (e.g., the DOC) converts NO to $NO_2$, which oxidizes the particulates in the particulate filter. This reaction is effective over the lower temperature range of 150 to 300° C. Above 300° C. the DOC is not effective in converting NO to $NO_2$. In the temperature range over 300° C., the high temperature catalyst (e.g., the particulate filter) is catalyzed to use the $O_2$ in the exhaust gas to oxidize the soot.

Thus, passive regeneration of the second substrate coated with the high temperature catalyst may occur over a wide range of temperatures (e.g., 150° C. and 600° C.), as indicated by curve 502 shown in FIG. 5. In this manner, a need for active regeneration due to particulate matter build-up in the second substrate may be reduced. As such, fuel consumption may be reduced as fuel injection for increasing temperature for active regeneration is reduced.

Figure 6:
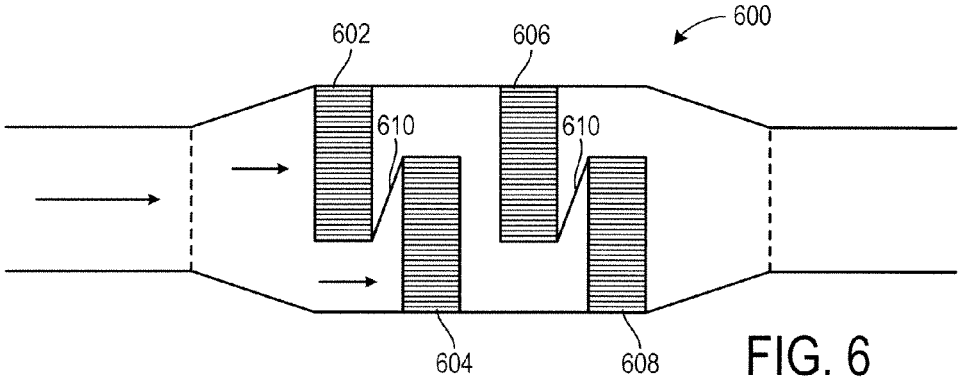
FIG. 6 shows a schematic diagram of an example embodiment of an exhaust gas treatment device according to an embodiment of the invention.

FIG. 6 shows another example embodiment of an exhaust gas treatment device 600. The exhaust gas treatment device 600 includes first substrate coated with a low temperature catalyst and a second substrate coated with a high temperature catalyst, such as the first substrate 402 and the second substrate 404 described above with reference to FIG. 4. In the example embodiment of FIG. 6, each of the catalysts is divided into a plurality of sub-substrates which split the exhaust flow into a corresponding number of portions.

In the example embodiment of FIG. 6, the first substrate is divided into a first sub-substrate 602 and a second sub-substrate 604 disposed downstream of the first sub-substrate 602, thereby splitting the exhaust gas flow into two different portions. As depicted, the first sub-substrate 602 extends partially across a radial extent of the exhaust gas treatment device such that a portion of the radial extent at the location of the first sub-substrate is not filled by the first sub-substrate. As such, a first portion of exhaust gas flows through the first sub-substrate 602 and a second portion of exhaust gas bypasses the first sub-substrate 602 and flows through the second sub-substrate 604. As depicted, the second sub-substrate 604 extends partially across a radial extent of the exhaust gas treatment device such that a portion of the radial extent at the second sub-substrate is not filled by the second sub-substrate. In some embodiments, the first sub-substrate 602 and the second sub-substrate 604 may be coated by the same low temperature catalyst. In other embodiments, the first sub-substrate 602 and the second sub-substrate 604 may be coated by different low temperature catalysts.

Further, a flow divider 610 interconnects distal edges of the first sub-substrate 602 and the second sub-substrate 604 that are not abutting the walls of the exhaust gas treatment device 600. In this manner, the flow divider 610 channels exhaust gas around each of the sub-substrates 602 and 604 such that each portion of exhaust gas flow flows through only one of the sub-substrates 602 and 604.

Further, in the example embodiment of FIG. 6, the second substrate is divided into a first sub-substrate 606 and a second sub-substrate 608 disposed downstream of the first sub-substrate, thereby splitting the exhaust gas flow into two different portions. The second substrate is disposed downstream of the first substrate. As depicted, the first sub-substrate 606 extends partially across a radial extent of the exhaust gas treatment device such that a portion of the radial extent at the location of the first sub-substrate is not filled by the first sub-substrate. As such, a first portion of exhaust gas flows through the first sub-substrate 606 and a second portion of exhaust gas bypasses the first sub-substrate 606 and flows through the second sub-substrate 608. As depicted, the second sub-substrate 608 extends partially across a radial extent of the exhaust gas treatment device such that a portion of the radial extent at the second sub-substrate is not filled by the second sub-substrate. In some embodiments, the first sub-substrate 606 and the second sub-substrate 608 may be coated by the same high temperature catalyst. In other embodiments, the first sub-substrate 606 and the second sub-substrate 608 may be coated by different high temperature catalysts.

Further, a flow divider 610 interconnects distal edges of the first sub-substrate 606 and the second sub-substrate 608 that are not abutting the walls of the exhaust gas treatment device 600. In this manner, the flow divider 610 channels exhaust gas around each of the sub-substrates 606 and 608 such that each portion of exhaust gas flow flows through only one of the sub-substrates 606 and 608.

By dividing the first sub-substrate into two sub-substrates 602 and 604, and dividing the second substrate into two sub-substrates 606 and 608, a surface area through which exhaust gas flows may be increased and a length along which each portion flows may be decreased, thereby reducing a pressure drop on the system. Further, in such a configuration, a size of the exhaust gas treatment device may be reduced thus enabling the device to be positioned in a system that has limited space. As such, a more compact exhaust gas treatment device may be enabled, the more compact exhaust gas treatment device capable of passive regeneration over a wide range of temperatures, as described with reference to FIGS. 4 and 5.

It should be understood FIG. 6 is provided as an example. The exhaust gas treatment device may include any suitable number of sub-substrates splitting the exhaust flow into a corresponding number of flow paths. In some embodiments, only the first substrate may be divided or only the second substrate may be divided. Further, a size and shape of each sub-substrate may vary based on the configuration of the sub-substrates within the exhaust gas treatment device.

Figure 7:
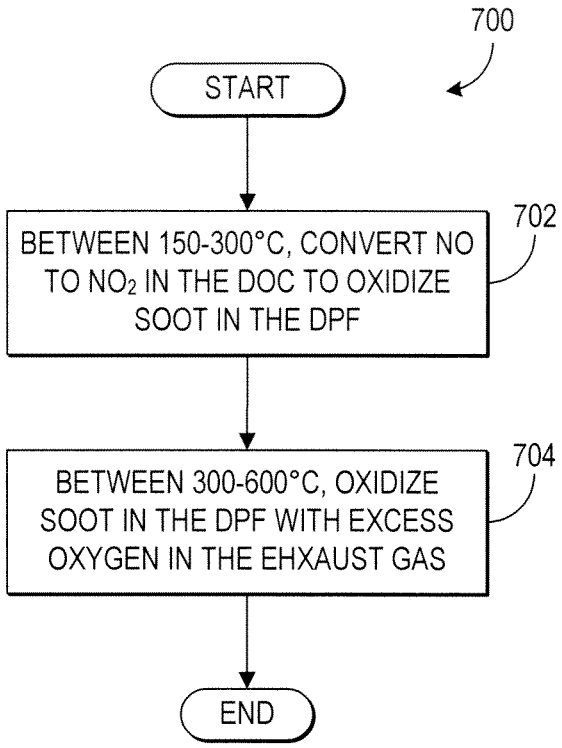
FIG. 7 shows a flow chart illustrating a method for an exhaust gas treatment device.

FIG. 7 shows a high level flow chart illustrating a method 700 for an exhaust gas treatment device, such as the exhaust gas treatment device 400 or 600 described above with reference to FIGS. 4 and 6, respectively.

At 702 of method 700, under exhaust gas temperatures between 150° C. and 300° C., nitric oxide (NO) is converted to nitrogen dioxide ($NO_2$) in the diesel oxidation catalyst (DOC). As described above, the DOC may be coated with a low temperature catalyst, such as platinum, which facilitates the reaction. The $NO_2$ formed in the DOC flows to the diesel particulate filter (DPF) where it oxidizes particulate matter, such as soot, thereby passively regenerating the DPF at low temperatures.

At 704 of method 700, under exhaust gas temperatures between 300° C. and 600° C., particulate matter such as soot is oxidized in the DPF with excess oxygen in the exhaust gas, thereby passively regenerating the DPF at high temperatures. As described above, the DPF may be coated with a high temperature catalyst which facilitates the oxidation of soot.

Thus, the DPF may be regenerated by passive regeneration over a wide range of temperatures. In this manner, fuel consumption may be reduced, thereby increasing fuel economy, as active regeneration may be carried out less frequently due to an increase in passive regeneration.

Another embodiment relates to an exhaust gas treatment device. The device comprises a first substrate and a second substrate positioned downstream of the first substrate. (For example, the first and second substrates may be located in a common passageway defined by a housing.) The first substrate is coated with a low temperature catalyst configured to operate under a first, low temperature range. The low temperature catalyst converts nitric oxide to nitrogen dioxide in the first, low temperature range. The second substrate is coated with a high temperature catalyst. The high temperature catalyst is configured to operate under a second, high temperature range. In the first and second temperature ranges, particulate matter is oxidized at the second substrate. More specifically, the nitrogen dioxide (generated by the low temperature catalyst and traveling downstream to the second substrate) oxidizes particulate matter in the second substrate in the first, low temperature range. Additionally, the high temperature catalyst reduces particulate matter in the second substrate with oxygen in exhaust gas when a temperature of the exhaust gas is in the second, high temperature range.

In another embodiment, an exhaust gas treatment device comprises a diesel oxidation catalyst and a diesel particulate filter located downstream of the diesel oxidation catalyst. The diesel oxidation catalyst has a first catalyst for converting nitric oxide to nitrogen dioxide for oxidizing particulate matter in the diesel particulate filter in a first, low temperature range. The diesel particulate filter has a second catalyst for oxidizing particulate matter in the diesel particulate filter in a second, high temperature range.

In another embodiment, an exhaust gas treatment device comprises a housing defining an internal passageway, a particulate matter filter in the passageway, and a plurality of catalysts disposed in the internal passageway. The plurality of catalysts is configured to oxidize particulate matter in the particulate matter filter in a first, low temperature range and in a second, high temperature range (e.g., one catalyst may work in the low temperature range, and another catalyst in the high temperature range).

In some examples, an engine system may be retrofitted with an exhaust gas treatment device as described in any of the embodiments herein. The exhaust gas treatment device may be added to the engine system in any suitable location in the exhaust passage, for example, the exhaust gas treatment device may be installed upstream or downstream of the turbine of the turbocharger.

Further, in some examples, an engine may be serviced by replacing an exhaust gas treatment device with an exhaust gas treatment device as described in any of the embodiments herein. In such an example, the exhaust gas treatment device may be replaced such that fuel economy of the engine system may be increased.

As explained above, the terms "high temperature" and "low temperature" are relative, meaning that "high" temperature is a temperature higher than a "low" temperature. Conversely, a "low" temperature is a temperature lower than a "high" temperature. As used herein, the term "between," when referring to a range of values defined by two endpoints, such as between value "X" and value "Y," means that the range includes the stated endpoints.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A vehicle system comprising:

an engine cab defined by a roof assembly and side walls;

an engine positioned in the engine cab such that a longitudinal axis of the engine is aligned in parallel with a length of the engine cab;

a turbocharger positioned at an end of the engine; and an exhaust gas treatment device mounted on the engine within a space defined by a top surface of an exhaust manifold of the engine, the roof assembly, and the side walls of the engine cab such that a longitudinal axis of the exhaust gas treatment device is aligned in parallel with the longitudinal axis of the engine, the exhaust gas treatment device including a first substrate coated with a low temperature catalyst positioned upstream of a second substrate coated with a high temperature catalyst, the exhaust gas treatment device disposed upstream of a turbine of the turbocharger and configured to receive exhaust gas from the exhaust manifold of the engine.

2. The vehicle system of claim 1, wherein the low temperature catalyst is configured to operate under a first, low temperature range, and the high temperature catalyst is configured to operate under a second, high temperature range.

3. The vehicle system of claim 2, wherein the first substrate coated with the low temperature catalyst is an oxidation catalyst, and the low temperature catalyst converts nitric oxide to nitrogen dioxide in the first, low temperature range, and the nitrogen dioxide oxidizes particulate matter in the second substrate in the first, low temperature range.

4. The vehicle system of claim 2, wherein the first, low temperature range is between 150° C. and 300° C.

5. The vehicle system of claim 2, wherein the second substrate is a particulate filter, and the high temperature catalyst reduces particulate matter in the second substrate with oxygen in exhaust gas when a temperature of the exhaust gas is in the second, high temperature range.

6. The vehicle system of claim 2, wherein the second, high temperature range is between 300° C. and 600° C.

7. The vehicle system of claim 1, wherein the high temperature catalyst is an oxidized ceramic material.

8. The vehicle system of claim 1, wherein the low temperature catalyst is a platinum group metal.

9. The vehicle system of claim 1, wherein the vehicle system is a locomotive system.

10. A vehicle system, comprising:

an engine cab defined by a roof assembly and side walls;

an engine positioned in the engine cab such that a longitudinal axis of the engine is aligned in parallel with a length of the engine cab;

a turbocharger positioned at an end of the engine; and an exhaust gas treatment device mounted on the engine within a space defined by a top surface of an exhaust manifold of the engine, the roof assembly, and the side walls of the engine cab such that a longitudinal axis of the exhaust gas treatment device is aligned in parallel with the longitudinal axis of the engine, the exhaust gas treatment device including a first substrate coated with a low temperature catalyst positioned upstream of a second substrate coated with a high temperature catalyst, the exhaust gas treatment device disposed upstream of a turbine of the turbocharger and configured to receive exhaust gas from the exhaust manifold of the engine, wherein the first substrate is an oxidation catalyst and the second substrate is a particulate filter.

11. The vehicle system of claim 10, wherein the low temperature catalyst is configured to operate under a first, low temperature range, and the high temperature catalyst is configured to operate under a second, high temperature range.

12. The vehicle system of claim 11, wherein the low temperature catalyst converts nitric oxide to nitrogen dioxide in the first, low temperature range, the nitrogen dioxide oxidizes particulate matter in the second substrate in the first, low temperature range, and the high temperature catalyst reduces particulate matter in the second substrate with oxygen in exhaust gas when a temperature of the exhaust gas is in the second, high temperature range.

13. The vehicle system of claim 11, wherein the first, low temperature range is between 150° C. and 300° C., and wherein the second, high temperature range is between 300° C. and 600° C.

14. The vehicle system of claim 10, wherein the high temperature catalyst is an oxidized ceramic material, and wherein the low temperature catalyst is a platinum group metal.

15. The vehicle system of claim 10, wherein the vehicle system is a locomotive system.

16. A vehicle system, comprising:

an engine cab defined by a roof assembly and side walls;

an engine positioned in the engine cab such that a longitudinal axis of the engine is aligned in parallel with a length of the engine cab;

a turbocharger positioned at an end of the engine; and an exhaust gas treatment device mounted on the engine within a space defined by a top surface of an exhaust manifold of the engine, the roof assembly, and the side walls of the engine cab such that a longitudinal axis of the exhaust gas treatment device is aligned in parallel with the longitudinal axis of the engine, the exhaust gas treatment device including a first substrate coated with a low temperature catalyst positioned upstream of a second substrate coated with a high temperature catalyst, the exhaust gas treatment device disposed upstream of a turbine of the turbocharger and configured to receive exhaust gas from the exhaust manifold of the engine, wherein a temperature operating range of the low temperature catalyst is between 150° C. and 300° C. and a temperature operating range of the high temperature catalyst is between 300° C. and 600° C.

17. The vehicle system of claim 16, wherein the first substrate coated with the low temperature catalyst is an oxidation catalyst, and the low temperature catalyst converts nitric oxide to nitrogen dioxide in the temperature operating range of the low temperature catalyst, and the nitrogen dioxide oxidizes particulate matter in the second substrate in the temperature operating range of the low temperature catalyst.

18. The vehicle system of claim 16, wherein the second substrate is a particulate filter, and the high temperature catalyst reduces particulate matter in the second substrate with oxygen in exhaust gas when a temperature of the exhaust gas is in the temperature operating range of the high temperature catalyst.

19. The vehicle system of claim 16, wherein the high temperature catalyst is an oxidized ceramic material, and wherein the low temperature catalyst is a platinum group metal.

20. The vehicle system of claim 16, wherein the vehicle system is a locomotive system.

* * * * *